US006668869B2

(12) United States Patent
Richardson

(10) Patent No.: US 6,668,869 B2
(45) Date of Patent: Dec. 30, 2003

(54) FENCE MESH FORMING MACHINE, KNOT BOX AND METHOD

(75) Inventor: Kenneth Sidney Richardson, North Canterbury (NZ)

(73) Assignee: South Fence Machinery Limited, Christchurch (NZ)

( * ) Notice: Subject to any disclaimer, the term of this patent is extended or adjusted under 35 U.S.C. 154(b) by 0 days.

(21) Appl. No.: 10/101,649

(22) Filed: Mar. 20, 2002

(65) Prior Publication Data

US 2003/0178090 A1 Sep. 25, 2003

(51) Int. Cl.[7] ..... B21F 27/08
(52) U.S. Cl. ..... 140/11; 140/7
(58) Field of Search ..... 140/3 R, 5, 6, 140/10, 11, 101, 9, 7

(56) References Cited

U.S. PATENT DOCUMENTS 1,027,454 A * 5/1912 Willits ..... 140/11
1,078,702 A * 11/1913 Sommer ..... 140/11
3,285,292 A * 11/1966 Crouch ..... 140/9

* cited by examiner

*Primary Examiner*—Lowell A. Larson
(74) *Attorney, Agent, or Firm*—Workman Nydegger

(57) ABSTRACT

A knot box for forming a knot at the intersection between a line wire and stay wire in a knotted fence mesh forming machine includes a staple former arranged to move towards the line wire-stay wire intersection at each operation of the knot box, cut a length of knot wire extending at an angle across the intersection, and bend the knot wire around the intersection, and a final former which moves toward the intersection from the other side and bends and wraps the ends of the knot wire about one of the wires to form a finished knot about the intersection. Supports may be provided to support the intersection or the length of bent knot wire about the intersection. A plurality of side-by-side knot boxes may be provided in a knotted fence mesh forming machine and may be arranged to simultaneously form the knots.

39 Claims, 13 Drawing Sheets

FENCE MESH FORMING MACHINE, KNOT BOX AND METHOD

CROSS-REFERENCE TO RELATED APPLICATIONS

Not applicable.

BACKGROUND OF THE INVENTION

1. The Field of the Invention

The present invention relates to apparatus for forming knotted fence mesh and, more specifically, knot boxes and methods of use.

2. The Relevant Technology

Forms of fence mesh are known in which the wires forming the fence are knotted together at each or many wire intersections. In general knotted fence mesh is stronger than wire fence in which the fence wires are not knotted together at their intersections and which it is typically used for domestic or light industrial applications. Knotted fence mesh is used for applications where additional strength is required, such as for containing larger or stronger animals such as horses or deer for example.

Knotted fence mesh with a rectangular or square mesh shape for example is typically formed from a number of generally parallel line wires, which will extend generally horizontally when the fence mesh is set in position between fence posts, and lengths of stay wire which extend laterally across the line wires at regular spacings (and generally vertically when the fence mesh is set in position). In machines for forming knotted fence mesh a number of continuous line wires are fed to a bed of the machine comprising a number of similar knot boxes, and stay wire is fed into the machine bed across the line wires. Such machines typically have a step-wise operation and form a series of knots along a length of stay wire at each intersection of the stay wire and the line wires at each operational step or "beat" of the machine. Typically such machines may operate at a rate of around 50 to 60 beats per minute. At each step or beat the line wires are advanced forward in parallel through the side by side knot boxes at the machine bed, stay wire is fed into the bed of the machine across the line wires at the knot boxes, at approximately 90 degrees to the line wires in case of a machine for forming rectangular fence mesh, a length of the stay wire is cut, and simultaneously at each knot box at an intersection between the line wires and the stay wire a knot securing the stay wire to the line wire is formed.

SUMMARY OF THE INVENTION

The invention provides an improved or at least alternative form of knot box for a fence mesh forming machine, and method of forming knotted fence mesh. The knot box and fence forming method of the invention are particularly suited for forming knotted fence mesh having a rectangular mesh shape and in which at each line wire-stay wire intersection a length of knot wire is wrapped or knotted around the intersection, but may be adapted for forming a knotted fence with a non-rectangular mesh shape such as a diamond mesh shape for example.

In accordance with a first aspect of the present invention, there is provided a knot box for forming a knot at the intersection between a line wire and a stay wire in a knotted fence mesh forming machine, the knot box including:

a staple former arranged to move towards the line wire-stay wire intersection from one side at each operation of the knot box, cut a length of knot wire extending at an angle across the line wire-stay wire intersection, and bend the cut length of knot wire around the line wire-stay wire intersection; and a final former arranged to move towards the line wire-stay wire intersection from the other side and bend and wrap the ends of the cut length of knot wire about the line wire or stay wire to form the finished knot about the line wire-stay wire intersection.

Preferably, the knot box includes a line wire-stay wire support arranged to support the line wire-stay wire intersection from the side opposite the staple former during movement of the staple former to cut and bend the length of knot wire.

Alternatively or in addition the knot box preferably includes a staple support arranged to support the length of knot wire bent about the line wire-stay wire intersection from the side opposite the line wire-stay wire support during movement of the final former to form the finished knot. Advantageously, the staple support and staple former are arranged to move towards the line wire-stay wire intersection concurrently.

Suitably, at least one of the staple former, final former, line wire-stay wire support and staple support is hydraulically actuated.

Preferably, the staple former includes a generally U-shaped forming surface to bend the cut length of knot wire around the line wire-stay wire intersection. A front face of the staple former may include a groove extending diagonally across the face for receipt of the knot wire, to align the knot wire on the desired angle relative to the line wire-stay wire intersection.

Alternatively or in addition the final former advantageously includes a generally U-shaped forming surface to bend and wrap the ends of the cut length of knot wire about the line wire or stay wire to form the finished knot about the line wire-stay wire intersection.

The knot box may include a slide box having a pair of side walls and an elongate channel formed between the side walls, in which channel the staple former, final former, line wire-stay wire support and/or staple support are slidably movable. Preferably, each of the side walls includes a recess for receiving the stay wire in a direction transverse to the elongate channel.

The knot box suitably defines an aperture in the base of the elongate channel, the aperture being for receipt of the line wire such that it extends through the slide box in a direction normal to the stay wire and normal to the elongate channel. A wire centering insert is preferably provided adjacent the aperture in the base of the elongate channel to align the line wire relative to the slide box.

The knot box preferably includes a knot wire insert having an aperture for receipt of the knot wire, the alignment of the aperture corresponding to the desired angle of the knot wire relative to the line wire-stay wire intersection.

In accordance with a second aspect of the present invention, there is provided a knotted fence mesh forming machine including a machine bed with a plurality of side by side knot boxes each for forming a knot at the intersection between a line wire and a stay wire, each of the knot boxes including:

a staple former arranged to move towards the line wire-stay wire intersection from one side at each operation of the knot box, cut a length of knot wire extending at an angle across the line wire-stay wire intersection, and bend the cut length of knot wire around the line wire-stay wire intersection; and a final former arranged to move towards the line wire-stay wire intersection from the other side and bend and wrap the ends of the cut length of knot wire about the line wire or stay wire to form the finished knot about the line wire-stay wire intersection.

Each knot box preferably further includes a line wire-stay wire support arranged to support the line wire-stay wire intersection from the side opposite the staple former during movement of the staple former to cut and bend the length of knot wire.

Alternatively or in addition, each knot box may include a staple support arranged to support the length of knot wire bent about the line wire-stay wire intersection from the side opposite the line wire-stay wire support during movement of the final former to form the finished knot.

Advantageously, in each knot box the staple support and staple former are arranged to move towards the line wire-stay wire intersection concurrently.

Preferably, each staple former includes a generally U-shaped forming surface to bend the cut length of knot wire around the line wire-stay wire intersection. Preferably, in each knot box a front face of the staple former includes a groove extending diagonally across the face for receipt of the respective knot wire, to align the knot wire on the desired angle relative to the line wire-stay wire intersection.

Alternatively or in addition each final former preferably includes a generally U-shaped forming surface to bend and wrap the ends of the cut length of knot wire about the line wire or stay wire to form the finished knot about the line wire-stay wire intersection.

Preferably, each knot box comprises a slide box having a pair of side walls and an elongate channel formed between the side walls, in which channel the staple former, final former, line wire-stay wire support and/or staple support are slidably movable. Each of the side walls may include a recess for receiving the stay wire transverse to the elongate channel.

The machine preferably includes a mechanism to project the stay wire across all of the knot boxes such that the stay wire extends through all of the recesses in the side walls of the knot boxes.

Preferably, each knot box defines an aperture in the base of the elongate channel, the aperture being for receipt of the line wire such that it extends through the slide box in a direction normal to the stay wire and normal to the elongate channel. A wire centering insert may be provided adjacent the aperture in the base of the elongate channel to align the line wire relative to the slide box.

Each knot box may include a knot wire insert having an aperture for receipt of the knot wire, the alignment of the aperture corresponding to the desired angle of the knot wire relative to the line wire-stay wire intersection.

The knot boxes are advantageously arranged to simultaneously form a knot at each of the line wire-stay wire intersections.

Preferably, the machine includes a staple former drive mechanism to move the staple formers simultaneously. The staple former drive mechanism may comprise a mechanical drive or, alternatively, may comprise a hydraulic drive. The staple former drive mechanism preferably includes a plurality of hydraulic cylinders connected to a drive bar which is operably connected to the plurality of staple formers.

Preferably, the machine includes a staple support drive mechanism to move the staple supports simultaneously. The staple support drive mechanism may include a mechanical drive or, alternatively, may include a hydraulic drive. The staple former drive mechanism preferably includes a plurality of hydraulic cylinders connected to a drive bar which is operably connected to the plurality of staple supports.

Alternatively, the staple formers and/or staple supports may be independently hydraulically actuated. Preferably, the machine may include a drive mechanism comprising a plurality of independent hydraulic cylinders having two rams, one ram being operably connected to a respective staple former, the other ram being operably connected to a respective staple support.

The knotted fence mesh forming machine advantageously includes a drive mechanism to independently move each line wire-stay wire support and final former. Preferably, the drive mechanism includes a plurality of independent hydraulic cylinders having two rams, one ram being operably connected to a respective line wire-stay wire support, the other ram being operably connected to a respective final former.

Alternatively, the machine may include a line wire-stay wire support drive mechanism to move the line wire-stay wire supports simultaneously. The line wire-stay wire support drive mechanism preferably includes a plurality of hydraulic cylinders connected to a drive bar which is operably connected to the plurality of line wire-stay wire supports.

The machine may include a final former drive mechanism to move the final formers simultaneously. The final former drive mechanism preferably includes a plurality of hydraulic cylinders connected to a drive bar which is operably connected to the plurality of final formers.

In accordance with a third aspect of the present invention, there is provided a method of forming a knot at an intersection between a line wire and a stay wire, the method including:

forming a line wire-stay wire intersection;

providing a knot wire adjacent the line wire-stay wire intersection, the knot wire extending at an angle across the line wire-stay wire intersection;

cutting the length of knot wire and bending the cut length of knot wire around the line wire-stay wire intersection; and bending and wrapping the ends of the cut length of knot wire about the line wire or stay wire to form a finished knot around the line wire-stay wire intersection.

Preferably, the method further includes supporting the line wire-stay wire intersection on the side opposite to the knot wire while bending the cut length of knot wire around the intersection.

Alternatively or in addition the method preferably further includes supporting the knot wire against the line wire-stay wire intersection while bending and wrapping the ends of the cut length of knot wire around the line wire or stay wire.

The method advantageously includes forming a number of line wire-stay wire intersections by providing a plurality of parallel line wires and providing a stay wire extending transversely across the plurality of line wires, and simultaneously at each line wire-stay wire intersection simultaneously forming a knot by:

providing a knot wire adjacent each line wire-stay wire intersection extending at an angle across the respective line wire-stay wire intersection;

cutting each length of knot wire and bending each cut length of knot wire around the respective line wire-stay wire intersection; and bending and wrapping the ends of each cut length of knot wire about the respective stay wire or the respective line wire to form a finished knot around each line wire-stay wire intersection.

In accordance with a fourth aspect of the present invention, there is provided knotted fence mesh formed by the method outlined in relation to the third aspect above.

BRIEF DESCRIPTION OF THE DRAWINGS

Preferred embodiments of the present invention will be described with reference to the accompanying drawings in which.

DETAILED DESCRIPTION OF THE PREFERRED EMBODIMENTS

Figure 1A:
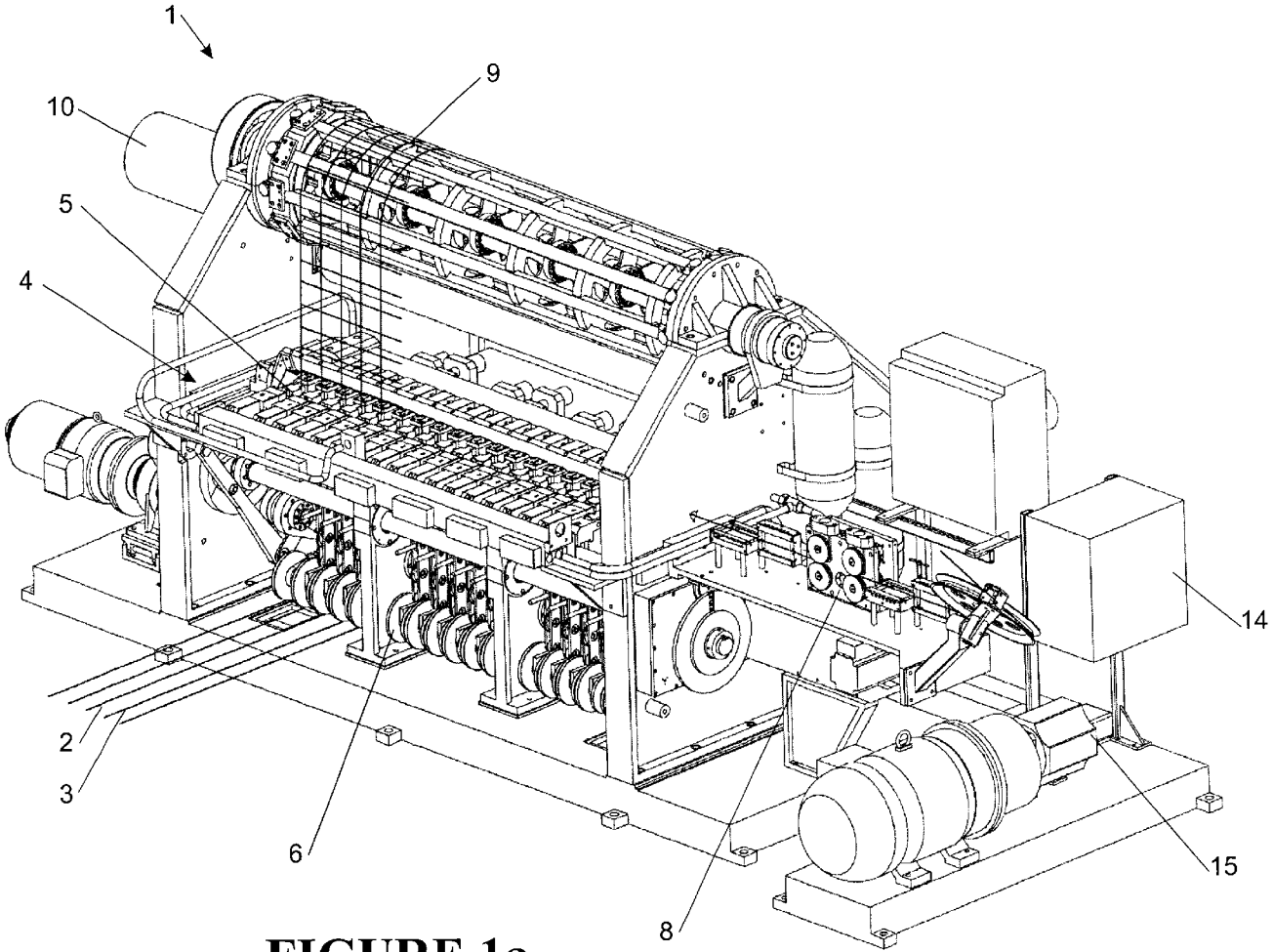
FIG. 1 shows perspective views of a knotted fence mesh forming machine, which includes a plurality of knot boxes.

With reference to FIG. 1, a knotted fence mesh forming machine is indicated generally by reference numeral 1.

Figure 1B:
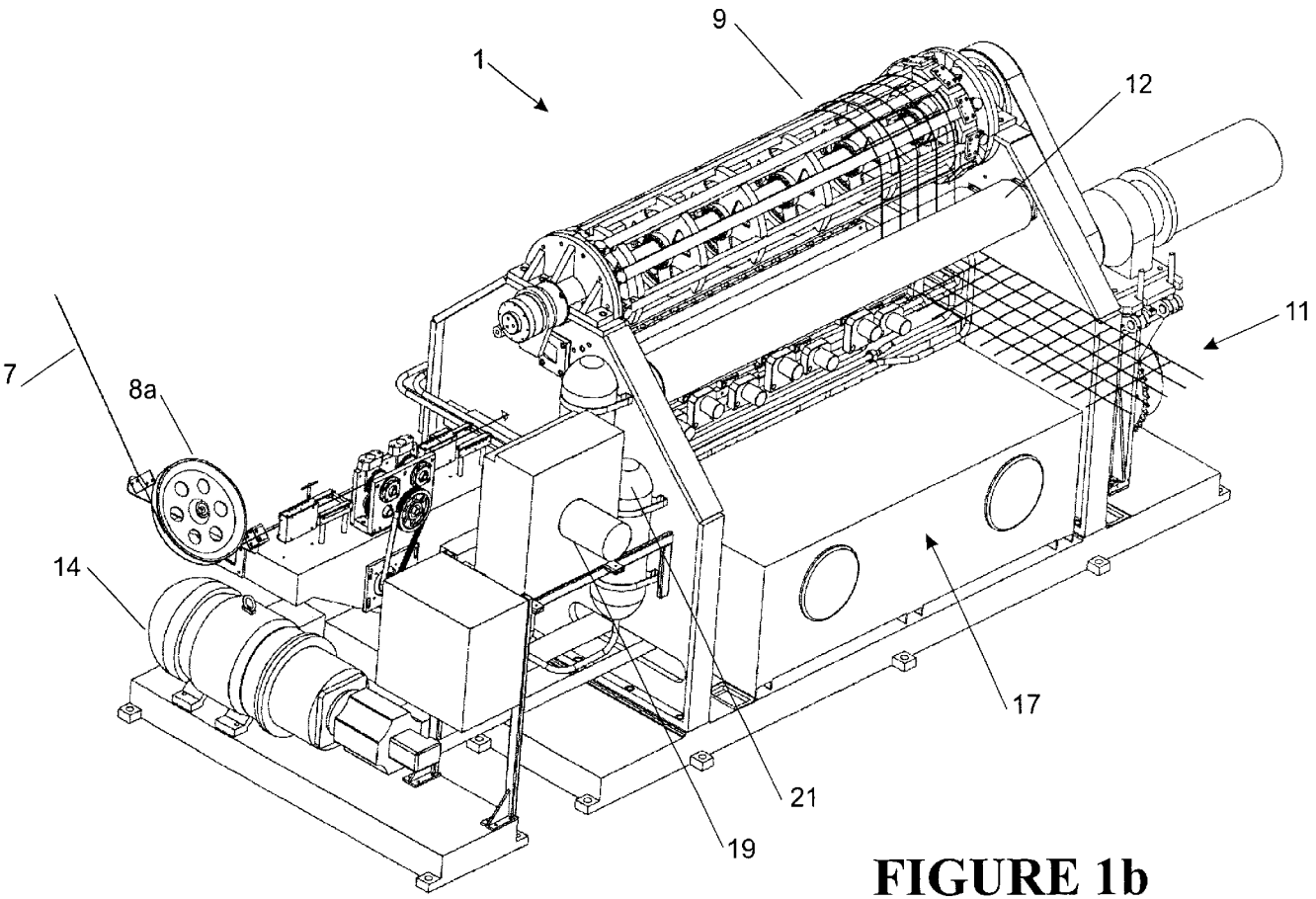

FIG. 1*a* shows a number of continuous line wires 2 and knot wires 3 being fed to a bed 4 of the machine 1, which bed has a plurality of side by side knot boxes 5. The line wires 2 enter the machine at its base, are turned through 90 degrees around rollers 6 and pass vertically through the knot boxes 5. One line wire 2 and one knot wire 3 pass through each knot box 5 with different orientations as will be described below with reference to FIG. 6. A continuous stay wire 7 is projected across the bed of the machine via a projecting mechanism having a system of driven rollers 8 and a free-running guide sheave 8*a* so as to transversely cross each of the knot boxes 5, thereby forming a plurality of stay wire-line wire intersections.

It will be appreciated that the line wires 2 are those which will extend generally horizontally when a fence mesh is set in position between fence posts, and the stay wires 7 are those which extend laterally across the line wires at regular spacings.

The machine 1 has a main drive roller 9 which pulls the completed fence mesh through the knot boxes 5, the drive roller being driven by an electric motor 10. The completed fence mesh (indicated generally by reference numeral 11 in FIG. 1*b*) then extends around a further roller 12, and would typically extend to a coiling machine or take-up unit (not shown) to form it into a coil for ease of handling and transportation.

The knotted fence mesh forming machine 1 generally has a step-wise operation and forms a series of knots along the length of stay wire 7 at each line wire-stay wire intersection at each step or "beat" of the machine. At each step or beat the line wires 2 are advanced forward in parallel through the side by side knot boxes 5 in the machine bed 4 via the drive roller 9, a stay wire 7 is fed into the bed 4 of the machine across the line wires at the knot boxes 5, at 90° for forming square fence mesh as shown, a length of the stay wire 7 is cut, and simultaneously in each knot box 5 at each intersection between the line wires and the stay wire a knot securing the stay wire to the line wire is formed.

It will be understood that the relative orientations of the wires may be varied depending on the type of fence mesh required, and the details of the knot boxes 5 will vary depending on the type of knots and fence mesh required. Knot boxes in accordance with a preferred embodiment of the present invention will be described with reference to FIGS. 2 to 8.

Knot boxes in knotted fence mesh forming machines are conventionally actuated using mechanical means. While the present machine could also be driven mechanically, the knot boxes 5 are preferably hydraulically actuated. Accordingly, the machine 1 includes an electric motor 14 driving a hydraulic pump 15, as well as a reservoir 17 for storing hydraulic fluid. A cooling fan 19 and hydraulic accumulators 21 are also provided. Further details of the hydraulic actuation of the knot boxes 5 will be described below.

FIG. 2 shows schematically a method in accordance with a preferred embodiment of the present invention for forming a knot around a line wire-stay wire intersection. With reference to FIG. 2*a,* in the first step of the method, an intersection is formed between a line wire 2 and a stay wire 7 which cross transversely. The stay wire 7 is supported against the line wire 2 in a notch 21 of a line wire-stay wire support 20. A knot wire 3 is provided to extend at an angle across the line wire-stay wire intersection.

Figure 2A:
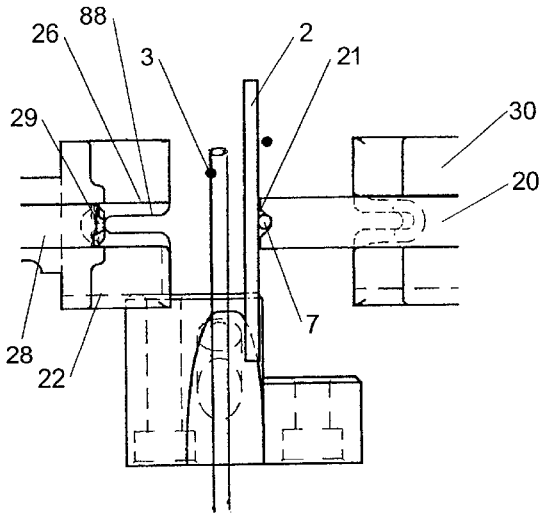
FIG. 2 shows schematically a method of forming a knot around a wire junction in accordance with a preferred embodiment of the present invention.
Figure 2B:
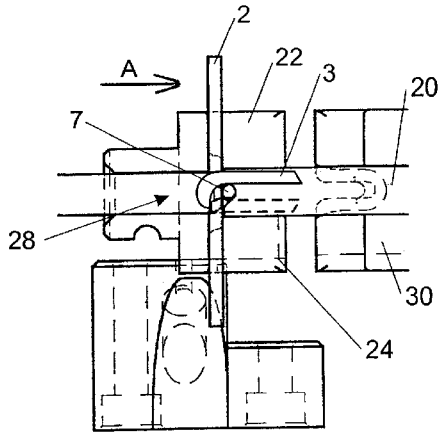

In the second step of the method, as shown in FIG. 2*b,* a staple former 22 moves in the direction indicated by Arrow A towards the line wire-stay wire intersection from the side opposite the line wire-stay wire support 20, shears a length of the knot wire 3, and bends the cut length of knot wire around the line wire-stay wire intersection to form a staple around the intersection. The staple former 22 includes a cutting edge 24 (shown in hidden detail in FIG. 2*b,* and more clearly in FIG. 7) to shear the knot wire, and a generally U-shaped forming surface 26 to bend the cut length of knot wire into a staple around the line wire-stay wire intersection. Movement of the line wire-stay wire intersection away from the knot wire 3 during staple forming is prevented by the line wire-stay wire support 20. Simultaneously with the forward movement of the staple former 22, a staple support 28 also moves forward in the direction indicated by Arrow A to support the bow of the bent knot wire 3 within a notch 29 in the staple support 28. The line wire-stay wire intersection is at this time still supported by the line wire-stay wire support 20.

Figure 2C:
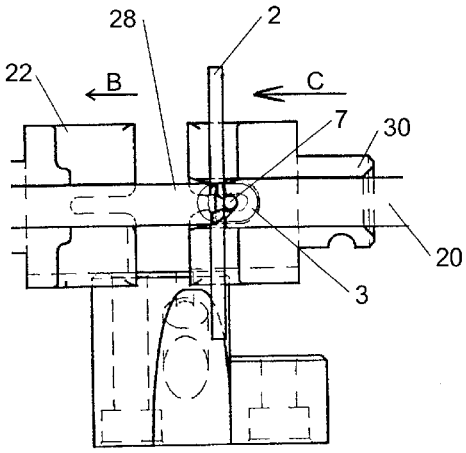

As shown in FIG. 2*c,* the staple former 22 then moves away from the wire intersection in the direction indicated by Arrow B, while a final former 30 moves in the direction indicated by Arrow C towards the wire intersection. The final former 30 also includes a generally U-shaped forming surface 32 which bends the ends of the cut length of knot wire 3 and wraps these around the stay wire 7. It will be appreciated that configuration of the forming surface 32 in the final former 30 could be altered to wrap the legs of the staple around the line wire 2 rather than the stay wire 7, although this would require a more complex forming surface shape. Alternatively, the line wire and the stay wire could be swapped in the knot box for this purpose.

Figure 2D:
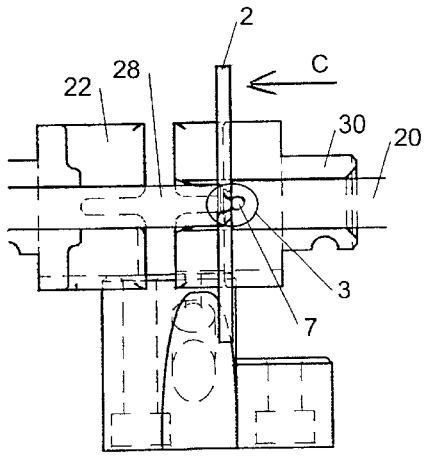

FIG. 2*d* shows the final knot formed around the line wire-stay wire intersection. Once the final knot has been formed, the final former 30, line wire-stay wire support 20 and staple support 28 can all move away from the knot, allowing the line wires 2 to be moved longitudinally to begin the next forming step.

Figure 3A:
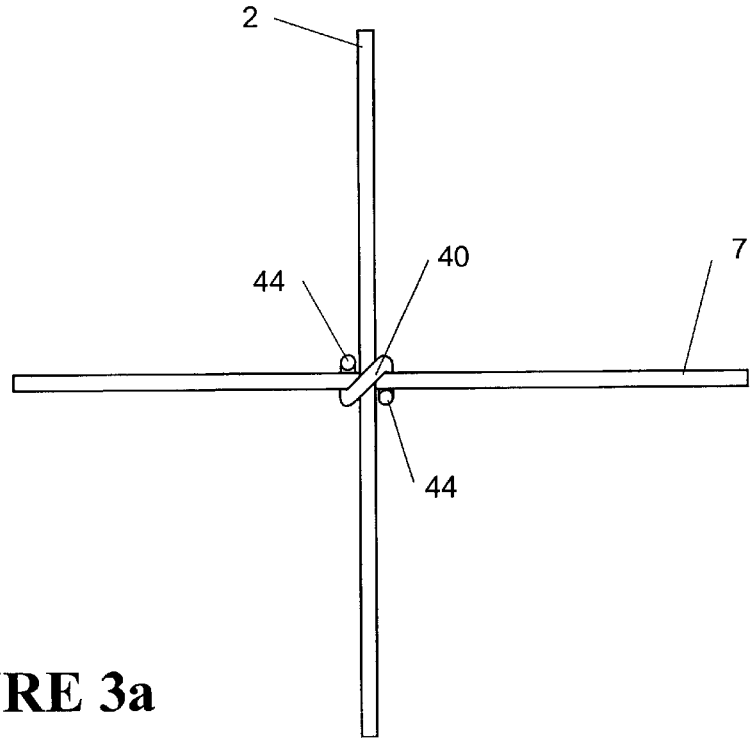
FIG. 3 shows opposite sides of a knot formed by the method described with reference to FIG. 2.
Figure 3B:
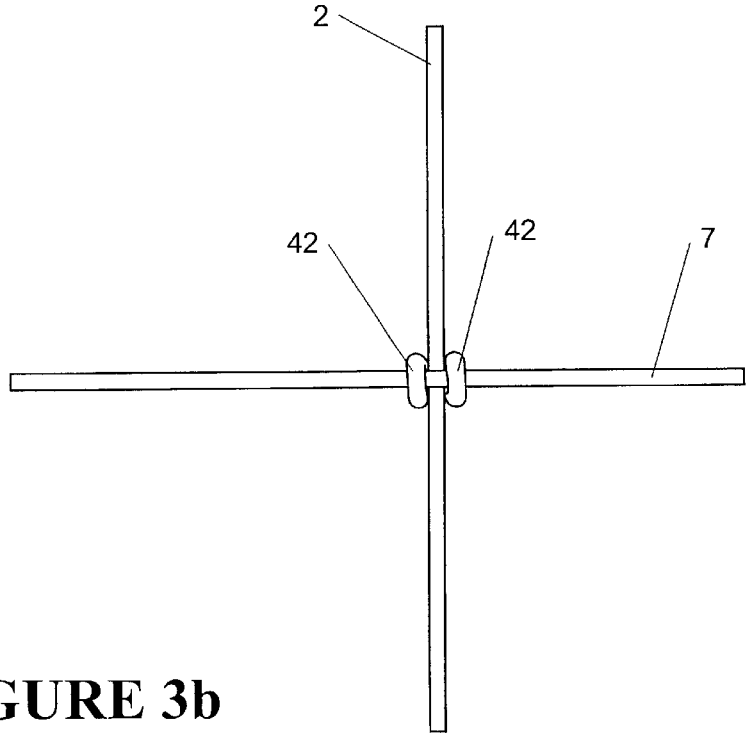

As shown in FIG. 3, the final knot has a bow portion 40 which is seated against the line wire 2 and extends diagonally around the line wire-stay wire intersection. The legs 42 of the final knot extend back around the stay wire 7 in opposite directions substantially parallel to each other, toward the bow portion 40. The ends 44 of the legs 42 are flat and substantially flush with the line wire 2, and have no protruding sharp edges. Therefore, the knot will not snag or cut the fur or flesh of an animal if it comes into contact with the ends 44 of the legs 42. The knotted wire mesh is also safer for handling during installation than conventional knotted wire mesh, due to a lack of sharp edges.

Figure 4:
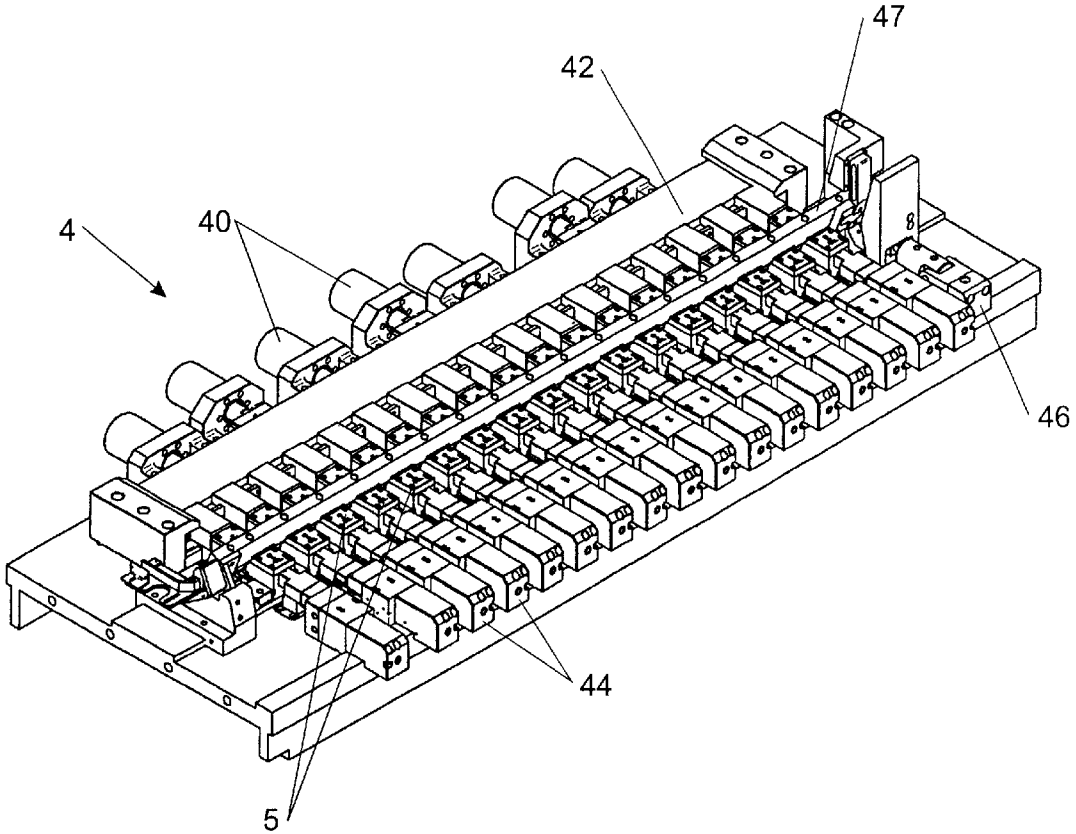
FIG. 4 shows a perspective view of the bed of the machine of FIG. 1 with knot boxes and drive mechanisms in accordance with a preferred embodiment of the present invention.

The machine bed 4 with a plurality of preferred knot boxes 5 and the associated drive mechanisms is shown in FIG. 4. The plurality of knot boxes 5 are located in side by side configuration. A plurality of hydraulic cylinders 40 are provided to drive a push bar assembly 42. The push bar assembly 42 includes two independently actuable bars (shown in FIG. 5), one of which is in operable connection with staple formers and the other of which is in operable connection with staple supports, as will be described with reference to FIGS. 5 and 6. Each alternate cylinder 40 drives one of the independently actuable bars, while the other cylinders drive the other bar, providing a substantially even force along the length of the bars. A plurality of hydraulic double cylinders 44 are provided to independently actuate each final former and line wire-stay wire support.

As mentioned above in relation to FIG. 1, the stay wire 7 is propelled across the knot boxes. A hydraulically-actuated stay wire placer assembly 46 may be provided to locate and grip the stay wire 7 across the knot boxes 5 prior to forming of the knots. The placer assembly 46 includes a stay wire placer bar 47 to locate the stay wire 7 in the required position. However, the stay wire placer bar 47 is not essential to the functioning of the machine, and is has been found that the stay wire 7 can be positioned in a satisfactory manner without using the placer bar 47. The stay wire 7 is cut to the required length as it is placed in position, prior to the knots being formed.

It will be appreciated that the stay wire 7 will be wrapped around the end line wires 2 in the completed fence mesh. This is achieved through the use of twister units, which are common to fence machinery. The operation of such twister units will be understood by a person skilled in the art, and will not be described further here.

Figure 5:
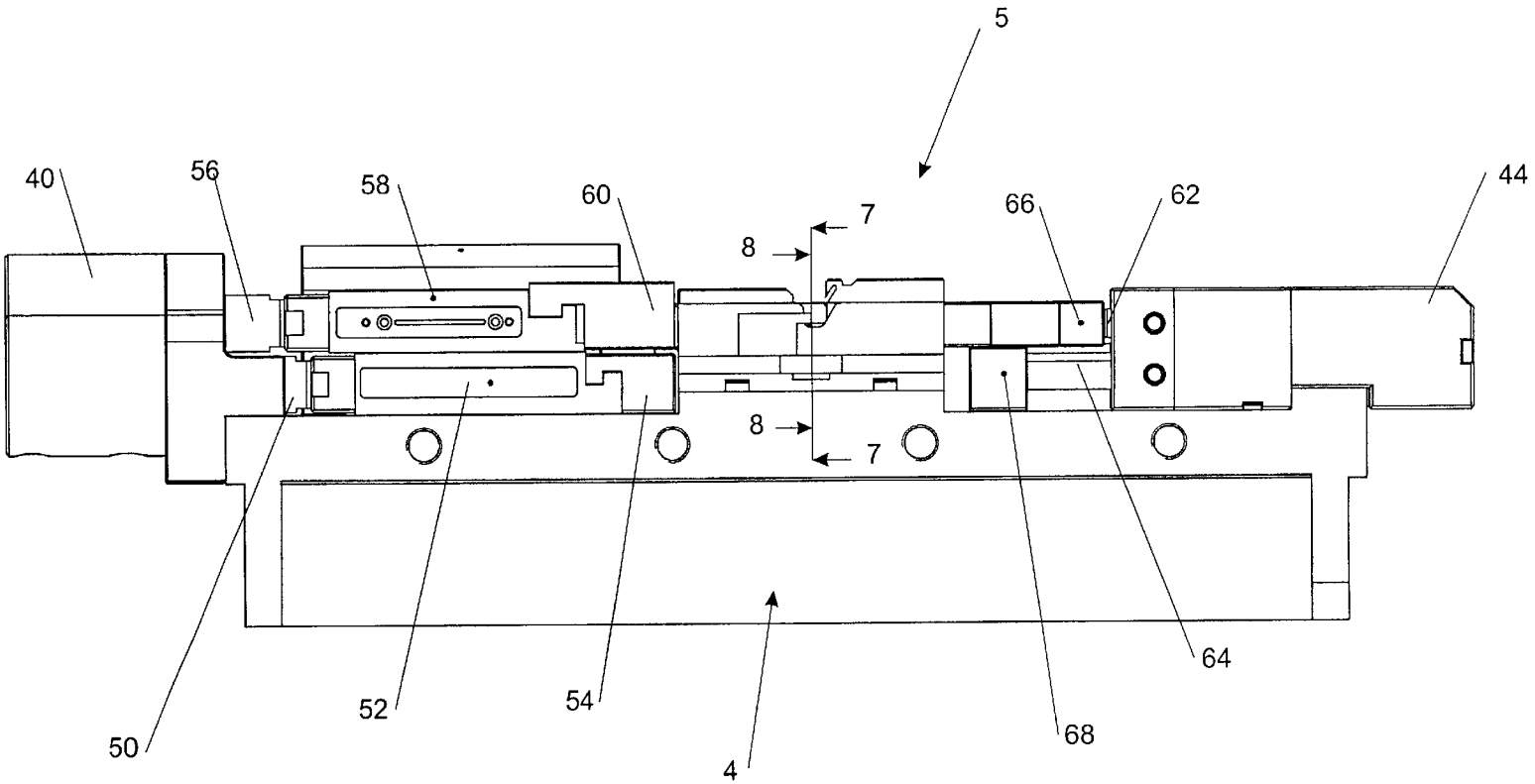
FIG. 5 shows an external side view of one of the knot boxes of FIG. 4.
Figure 6:
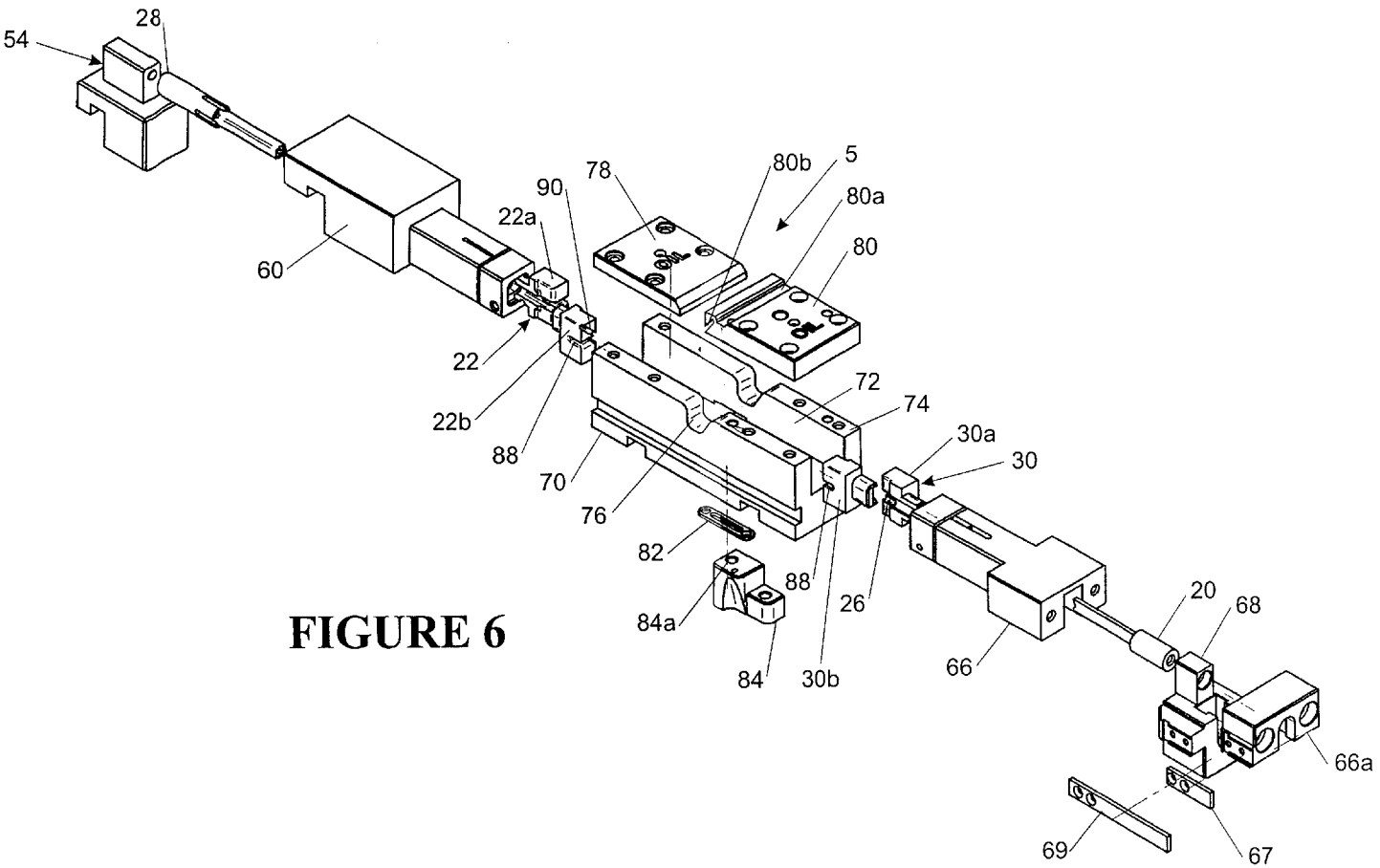
FIG. 6 shows an exploded perspective view of the components of one of the knot boxes of FIG. 4.

With reference to FIG. 5, each alternative hydraulic cylinder 40 has a ram 50 which drives a staple support drive bar 52 which is attached to brackets of a plurality of staple support holders 54, each of which staple support holders 54 holds a staple support (see FIG. 6). The other hydraulic cylinders (which are not visible in the Figure) each have a ram 56 which drives a staple former drive bar 58 which is attached to brackets of a plurality of staple former holders 60, each of which staple former holders 60 holds a staple former (see FIG. 6).

The staple support drive bar 52 is elongate and extends the width of all of the knot boxes 5 on the machine bed 4, so that all staple supports are moved simultaneously upon movement of the staple support drive bar 52. Similarly, the staple former drive bar 58, while being actuable independently of the staple support drive bar 52, also extends the width of all of the knot boxes 5 so that all staple formers are moved simultaneously upon movement of the staple former drive bar 58.

Alternatively, the staple supports and/or staple formers could be driven independently, in a similar manner to that described below with reference to the final formers and line wire-stay wire supports.

Each hydraulic cylinder 44 on the opposite side of the machine bed has two independently actuable rams 62, 64. One of the rams 62 drives a final former holder 66 which holds a final former (see FIG. 6), while the other ram 64 drives a line wire-stay wire support holder 68 which holds a line wire-stay wire support (see FIG. 6). Each knot box has its own hydraulic cylinder 44, meaning that each final former and line wire-stay wire support is actuable independently of all the others. It has been found that utilizing individual hydraulic cylinders to actuate the final formers and line wire-stay wire supports independently provides even pressure for the final forming of each knot, resulting in very tight and strong knots being formed.

Alternatively, the final formers and/or line wire-stay wire supports could be driven simultaneously by hydraulic cylinders linked by drive bars, in a similar manner to that described above with reference to the staple supports and staple formers.

As shown in FIG. 6, each knot box 5 includes a slide box 70 within which the knot is formed. The slide box includes a main longitudinal through channel 72 formed between two side walls 74 within which channel the staple former 22 and final former 30 are slidably movable. The staple former holder 60 and final former holder 66 each include a narrow body part and a wide body part, the narrow body part of each being sized to slidably fit within the channel 72. The transition between the narrow body part and wide body part on each of the staple former holder 60 and the final former holder 66 forms a stop, which prevents the staple former and final former from moving too far inwardly within the slide box 70.

A bracket part 66*a* is provided to connect the final former holder 66 to its respective ram 62 of the hydraulic cylinder 44 (shown in FIG. 5). A short sensor finger 67 extends outwardly from the bracket part 66*a*, and a long sensor finger 69 extends outwardly from the line wire-stay wire support holder 68.

The top central portion of each side wall 74 of the slide box includes an arcuate recess 76, through which the stay wire (not shown) extends in use. Two retainer plates 78, 80 are removably attached to the tops of the side walls 74, and are sized such that there is a transverse space between the retainer plates 78, 80 corresponding to the position of the recesses 76. This allows the stay wire and the knotted fence mesh to be moved upwardly out of the recesses 76 once a row of knots has been formed.

A groove 80*a* is provided in the top of the retainer plate 80. This groove provides clearance for the stay wire placer bar 47 as it pivots forward to place the stay wire. A downwardly-angled slot 80*b* is provided in an end of the retainer plate 80. As the stay wire is projected across the bed of the machine, it extends through the slots 80*b*. These slots provide guidance for the stay wire which is moved downwardly at an angle out of the slots to form the wire intersection. This feature isn't essential, as the stay wire 7 can be projected through the arcuate recesses 76 of the slide boxes and then pushed forwards into position.

The base of the slide box 70 includes a central aperture (not shown) through which a knot wire and stay wire extend in use. A wire centering insert 82 is provided to align the line wire 2 as it enters the slide box 70. A knot wire insert 84 is also provided, and is shown in more detail in FIG. 7. The knot wire insert 84 has a through aperture 84*a* having an alignment corresponding to the desired alignment of the knot wire 3 relative to the staple former 22. The knot wire 3 is fed into the slide box 70 through the aperture 84*a* in the knot wire insert 84.

The staple former 22 and final former 30 each comprise two parts 22*a*, 22*b* and 30*a*, 30*b* respectively. The staple former holder 60 and staple former 22 are hollow to allow the staple support 28 to slidably move therein. Similarly, the final former holder 66 and the final former 30 are hollow to allow the line wire-stay wire support 20 to slidably move therein.

Figure 7:
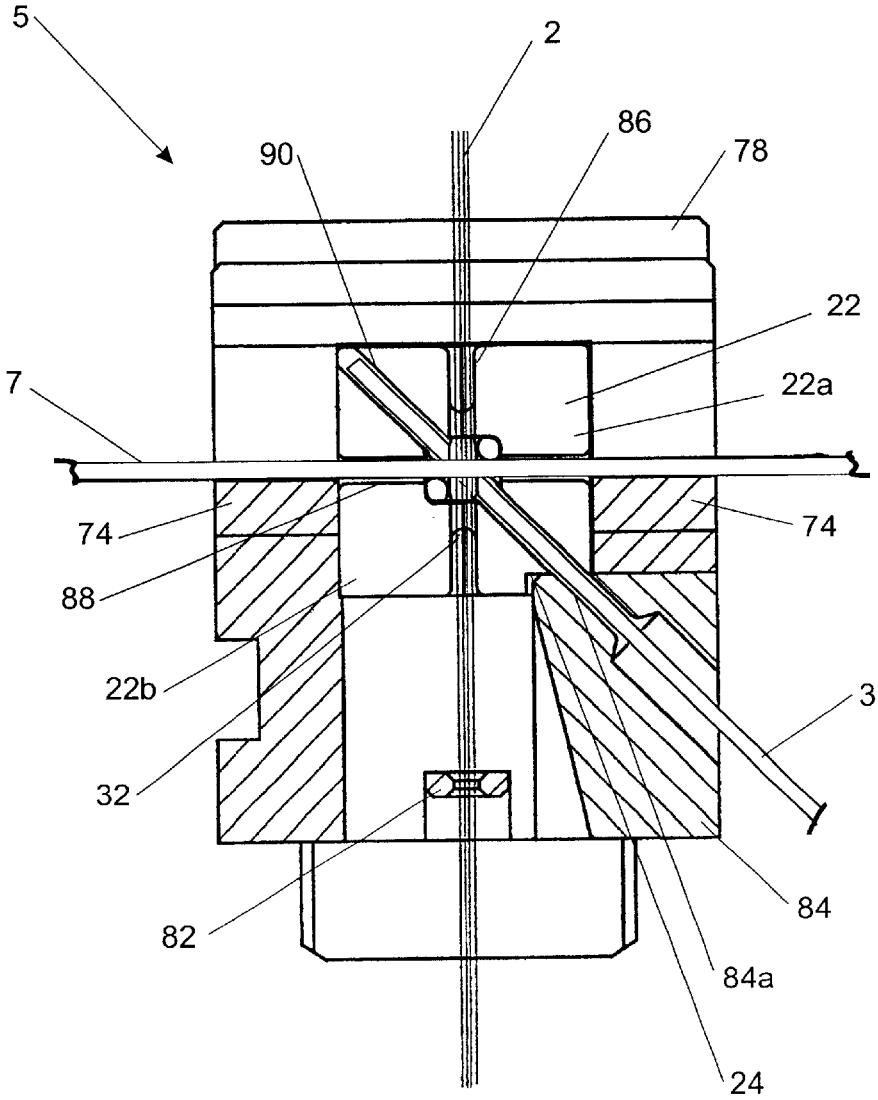
FIG. 7 shows a transverse sectional view of the interior of a knot box along line 7—7 of FIG. 5, with the wires in position ready for knot forming.

As shown in FIG. 7, when the halves of the staple former 22 are adjoined, they provide a vertical slot 86 for receipt of the vertical line wire (orientation with respect to the drawing) as well as a horizontal slot 88 for receipt of the horizontal stay wire (orientation with respect to the drawing) when the staple former 22 is in its forwardmost position within the channel 72. The central portion of the staple former 22 also provides an enlarged generally U-shaped forming surface 26 for bending the knot wire, as will be more readily apparent from FIG. 2*a*.

Figure 8:
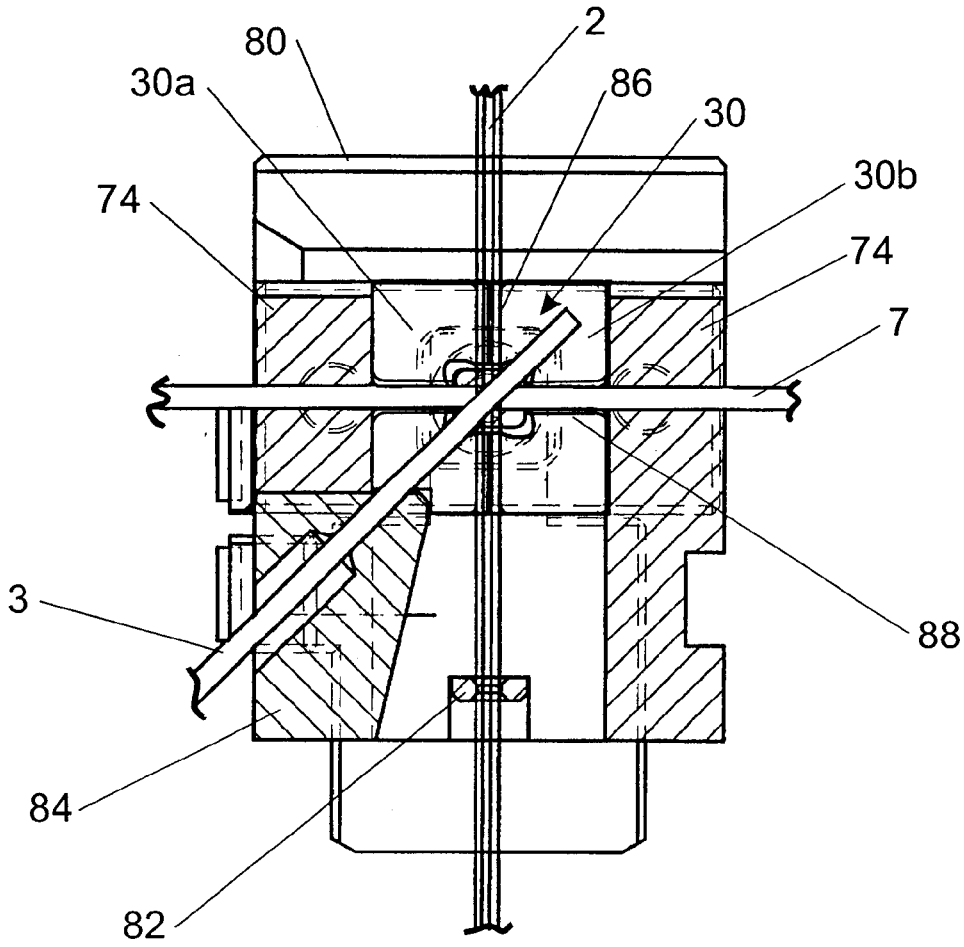
FIG. 8 shows a transverse sectional view of the interior of a knot box along line 8—8 of FIG. 5, with the wires in position ready for knot forming.

Similarly, as shown in FIG. 8 when the halves of the final former 30 are adjoined, they also provide a vertical slot 86 for receipt of the vertical line wire as well as a horizontal slot 88 for receipt of the horizontal stay wire when the final former 30 is in its forwardmost position within the channel 72. The central portion of the final former 30 also provides an enlarged generally U-shaped forming surface 32 for contacting and bending the legs of the knot wire back around the stay wire, as will be apparent from FIG. 2*b*.

As shown in FIG. 6, the front face of the staple former 22 includes a diagonal groove 90 which corresponds to the position of the knot wire prior to it being bent around the line wire-stay wire intersection. As can be readily seen from FIG. 7, the diagonal groove 90 is present in both halves 22*a*, 22*b* of the staple former.

The staple former parts 22*a*, 22*b* and final former parts 30*a*, 30*b* can be easily removed from their respective holders for replacement as they wear down.

FIG. 9 is similar to FIG. 2, but shows additional details of the components of the preferred knot boxes.

Figure 9A:
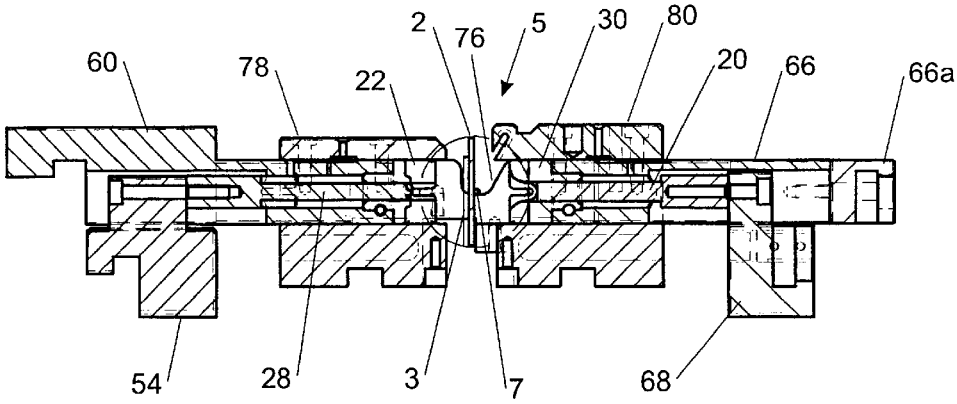
FIG. 9 shows longitudinal sectional views of one of the knot boxes of FIG. 4, showing the steps of forming a knot at a wire junction.
Figure 9B:
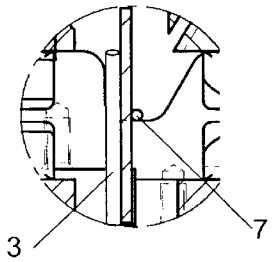

In FIG. 9*a*, the line wire 2 and stay wire 7 are formed into an intersection within the knot box 5, and the knot wire 3 is provided across the intersection at an angle to the line wire 2 and stay wire 7. The line wire 2 extends vertically through the knot box 5, whereas the stay wire 7 extends transversely across the knot box through the arcuate recesses 76 in the side walls 74, and is located against the base parts of the arcuate recesses 76. The line wire-stay wire support 20, staple former 22, staple support 28 and final former 30 are all shown in their outermost positions, and are all clear of the line wire-stay wire intersection. FIG. 9*b* shows a close-up view of part of the knot box of FIG. 9*a*.

Figure 9C:
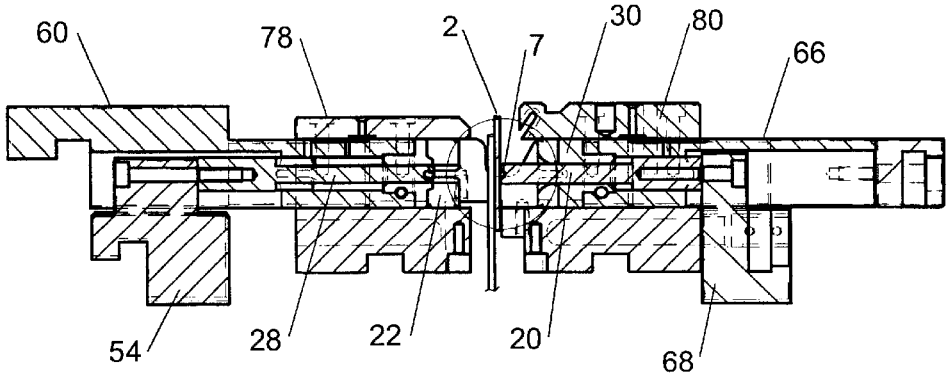
Figure 9D:
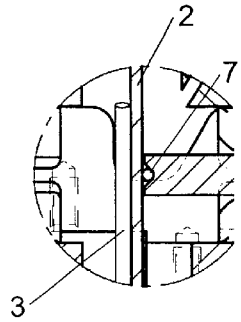

In FIG. 9*c*, the line wire-stay wire support 20 has been moved inwardly, via the line wire-stay wire support holder 68 and hydraulic ram 64 (FIG. 5) to support the stay wire 7 against the line wire 2. FIG. 9*d* shows a close-up view of part of the knot box of FIG. 9*c*.

Figure 9E:
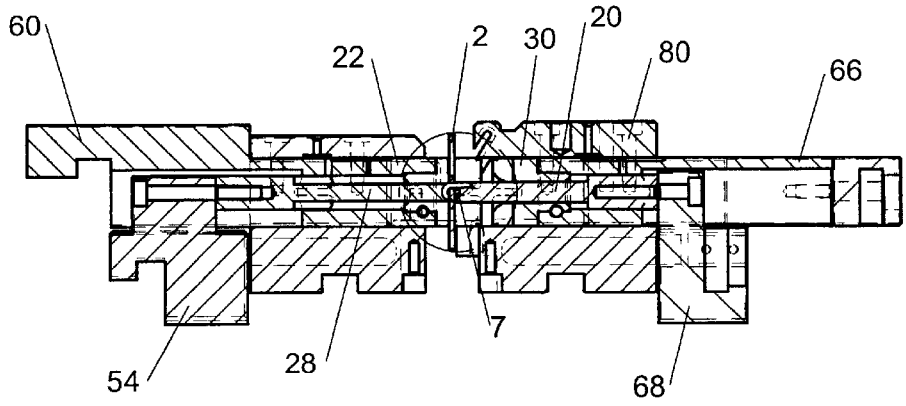
Figure 9F:
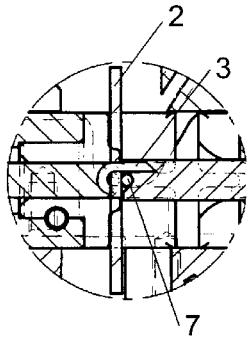

The staple support 28 and staple former 22 are then moved inwardly simultaneously via the respective rams 50, 56, the respective drive bars 52, 58, and the respective holders 54, 60 to bend the knot wire 3 around the line wire-stay wire intersection as shown in FIG. 9*e*. FIG. 9*f* shows a close-up view of part of the knot box of FIG. 9*e*. As the staple former 22 moves towards the inward position, the knot wire 3 is initially received in the diagonal groove 90 of the staple former and is sheared by an edge 24 of the staple former 22. As the staple former moves further inwardly, the knot wire is bent by the generally U-shaped forming surface 26 into a staple around the line wire-stay wire intersection. In the forwardmost position of the staple former 22, the line wire 2 is located in the vertical slot 86 of the staple former 22 and the stay wire 7 is located in the horizontal slot 88 of the staple former 22 (slots are shown in FIG. 7). The formed staple and the line wire-stay wire intersection are held between the line wire-stay wire support 20 and the staple support 28.

While the staple support 28 is described as moving forward concurrently with the staple former 22, it will be appreciated that it could be moved independently.

Figure 9G:
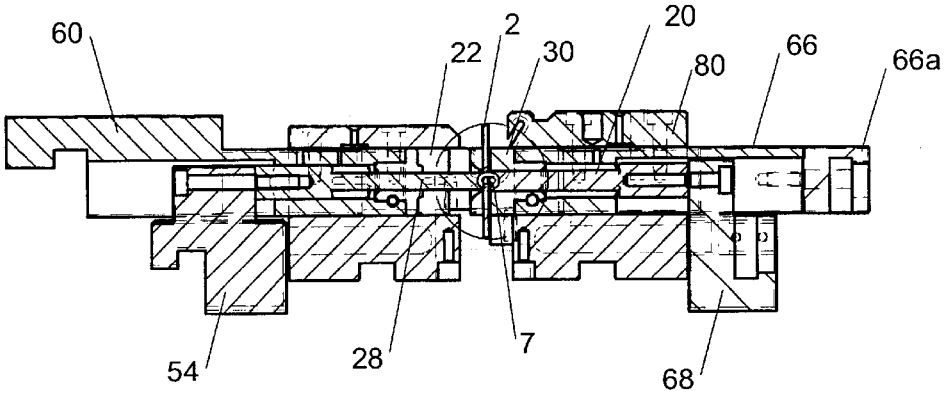
Figure 9H:
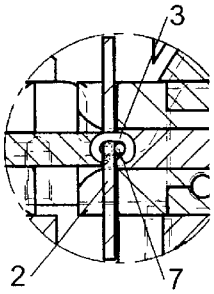

The staple former 22 is then moved outwardly away from the line wire-stay wire intersection while, via the ram 62, bracket part 66A and final former holder 66, the final former 30 is moved inwardly towards the line wire-stay wire intersection to the position shown in FIG. 9*g*. FIG. 9*h* shows a close-up view of part of the knot box of FIG. 9*g*. The generally U-shaped forming surface 26 of the final former 30 bends the ends of the staple around the stay wire 7 to form the final knot. When the final former 30 is in the position shown in FIG. 7*d*, the line wire 2 is located in the vertical slot 86 of the final former and the stay wire 7 is located in the horizontal slot 88 of the final former.

The line wire-stay wire support 20, staple support 28, and final former 30 are all then moved outwardly away from the line wire-stay wire intersection to enable the completed row of knots to be pulled upwardly. The sensor fingers 67, 69 indicate to a programmable logic controller that the final former 30 and line wire-stay wire support 30 have reached the outermost position, at which time the completed row of knots is moved upwardly out of the knot boxes 5. The process is then repeated to form the next row of knots.

The preferred knot box, machine and method described above have a number of advantages over those that are conventionally known.

A conventional knotted fence mesh forming machine has an operating rate of approximately 50 to 60 beats per second. It has been found that, by forming the staples around the line wire-stay wire intersections, an operating rate of 80 beats per minute is attainable.

Knotted fence mesh forming machines are conventionally mechanically actuated, meaning that each knot box of the machine must be individually adjusted and calibrated. The hydraulic cylinders used in the preferred machine are effectively self-adjusting, saving labor time and expense.

By independently hydraulically actuating at least the final formers and line wire-stay wire supports, and preferably also the staple formers and staple supports, even pressure is provided for the final forming of each knot, resulting in consistently strong and tight knots being formed.

While preferred embodiments of the invention has been described herein, it should be appreciated that improvements or modifications thereto may be made without departing from the scope of the following claims.

What is claimed is:

1. A knot box for forming a knot at the intersection between a line wire and a stay wire in a knotted fence mesh forming machine, the knot box comprising:

a staple former arranged to move towards the line wire-stay wire intersection from one side at each operation of the knot box, cut a length of knot wire extending at an angle across the line wire-stay wire intersection, and bend the cut length of knot wire around the line wire-stay wire intersection; and a final former arranged to move towards the line wire-stay wire intersection from the other side and bend and wrap the ends of the cut length of knot wire about the line wire or stay wire to form the finished knot about the line wire-stay wire intersection.

2. The knot box as claimed in claim 1, further comprising a line wire-stay wire support arranged to support the line wire-stay wire intersection from the side opposite the staple former during movement of the staple former to cut and bend the length of knot wire.

3. The knot box as claimed in claim 1, further comprising a staple support arranged to support the length of knot wire bent about the line wire-stay wire intersection from the side opposite the final former during movement of the final former to form the finished knot.

4. The knot box as claimed in claim 3, wherein the staple support and staple former are arranged to move towards the line wire-stay wire intersection concurrently.

5. The knot box as claimed in claim 1, wherein at least one of the staple former, final former, a line wire-stay wire support and a staple support is hydraulically actuated.

6. The knot box as claimed in claim 1, wherein the staple former comprises a generally U-shaped forming surface to bend the cut length of knot wire around the line wire-stay wire intersection.

7. The knot box as claimed in claim 1, wherein a front face of the staple former comprises a groove extending diagonally across the face for receipt of the knot wire, to align the knot wire on the desired angle relative to the line wire-stay wire intersection.

8. The knot box as claimed in claim 1, wherein the final former comprises a generally U-shaped forming surface to bend and wrap the ends of the cut length of knot wire about the line wire or stay wire to form the finished knot about the line wire-stay wire intersection.

9. The knot box as claimed claim 1, wherein the knot box comprises a slide box having a pair of side walls and an elongate channel formed between the side walls, at least the staple former, final former, a line wire-stay wire support a staple support being slidably movable within the elongated channel.

10. The knot box as claimed in claim 9, wherein each of the side walls comprises a recess for receiving the stay wire in a direction transverse to the elongate channel.

11. The knot box as claimed in claim 10, wherein the knot box defines an aperture in the base of the elongate channel, the aperture being for receipt of the line wire such that it extends through the slide box in a direction normal to the stay wire and normal to the elongate channel.

12. The knot box as claimed in claim 11, including a wire centering insert adjacent the aperture in the base of the elongate channel to align the line wire relative the slide box.

13. The knot box as claimed claim 1, comprising a knot wire insert having an aperture for receipt of the knot wire, the alignment of the aperture corresponding to the desired angle of the knot wire relative to the line wire-stay wire intersection.

14. A knotted fence mesh forming machine comprising a machine bed with a plurality of side by side knot boxes each for forming a knot at the intersection between a line wire and a stay wire, each of the knot boxes comprising:

a staple former arranged to move towards the line wire-stay wire intersection from one side at each operation of the knot box, cut a length of knot wire extending at an angle across the line wire-stay wire intersection, and bend the cut length of knot wire around the line wire-stay wire intersection; and a final former arranged to move towards the line wire-stay wire intersection from the other side and bend and wrap the ends of the cut length of knot wire about the line wire or stay wire to form the finished knot about the line wire-stay wire intersection.

15. The knotted fence mesh forming machine as claimed in claim 14, wherein each knot box further comprises a line wire-stay wire support arranged to support the line wire-stay wire intersection from the side opposite the staple former during movement of the staple former to cut and bend the length of knot wire.

16. The knotted fence mesh forming machine as claimed in claim 14, wherein each knot box further comprises a staple support arranged to support the length of knot wire bent about the line wire-stay wire intersection from the side opposite the final former during movement of the final former to form the finished knot.

17. The knotted fence mesh forming machine as claimed in claim 16, wherein in each knot box the staple support and staple former are arranged to move towards the line wire-stay wire intersection concurrently.

18. The knotted fence mesh forming machine as claimed in claim 14, wherein each knot box comprises a slide box having a pair of side walls and an elongate channel formed between the side walls, at least the staple former, final former, a line wire-stay wire support a staple support being slidably movable within the elongated channel.

19. The knotted fence mesh forming machine as claimed in claim 18, wherein each of the side walls comprises a recess for receiving the stay wire in a direction transverse to the elongate channel.

20. The knotted fence mesh forming machine as claimed in claim 19, comprising a mechanism to project the stay wire across all of the knot boxes such that the stay wire extends through all of the recesses in the side walls of the knot boxes.

21. The knotted fence mesh forming machine as claimed in claim 14, wherein the knot boxes are arranged to simultaneously form a knot at each of the line wire-stay wire intersections.

22. The knotted fence mesh forming machine as claimed in claim 14, comprising a staple former drive mechanism to move the staple formers simultaneously.

23. The knotted fence mesh forming machine as claimed in claim 22, wherein the staple former drive mechanism comprises a hydraulic drive.

24. The knotted fence mesh forming machine as claimed in claim 23, wherein the staple former drive mechanism comprises a plurality of hydraulic cylinders connected to a drive bar which is operably connected to the plurality of staple formers.

25. The knotted fence mesh forming machine as claimed in claim 16, comprising a staple support drive mechanism to move the staple supports simultaneously.

26. The knotted fence mesh forming machine as claimed in claim 25, wherein the staple support drive mechanism comprises a hydraulic drive.

27. The knotted fence mesh forming machine as claimed in claim 26, wherein the staple support drive mechanism comprises a plurality of hydraulic cylinders connected to a drive bar which is operably connected to the plurality of staple supports.

28. The knotted fence mesh forming machine as claimed in claim 16, comprising a drive mechanism to independently actuate the staple supports and/or the staple formers.

29. The knotted fence mesh forming machine as claimed in claim 28, wherein the drive mechanism comprises a plurality of independent hydraulic cylinders having two rams, one ram being operably connected to a respective staple support, the other ram being operably connected to a respective staple former.

30. The knotted fence mesh forming machine as claimed in claim 15, comprising a drive mechanism to independently move each line wire-stay wire support and final former.

31. The knotted fence mesh forming machine as claimed in claim 30, comprising a plurality of independent hydraulic cylinders having two rams, one ram being operably connected to a respective line wire-stay wire support, the other ram being operably connected to a respective final former.

32. The knotted fence mesh forming machine as claimed in claim 15, comprising a line wire-stay wire support drive mechanism to move the line wire-stay wire supports simultaneously.

33. The knotted fence mesh forming machine as claimed in claim 32, wherein the line wire-stay wire support drive mechanism comprises a plurality of hydraulic cylinders connected to a drive bar which is operably connected to the plurality of line wire-stay wire supports.

34. The knotted fence mesh forming machine as claimed in claim 14, comprising a final former drive mechanism to move the final formers simultaneously.

35. The knotted fence mesh forming machine as claimed in claim 34, wherein the final former drive mechanism comprises a plurality of hydraulic cylinders connected to a drive bar which is operably connected to the plurality of final formers.

36. A method of forming a knot at an intersection between a line wire and a stay wire, the method comprising:

forming a line wire-stay wire intersection;

providing a knot wire adjacent the line wire-stay wire intersection, the knot wire extending at an angle across the line wire-stay wire intersection;

cutting the length of knot wire and bending the cut length of knot wire around the line wire-stay wire intersection; and bending and wrapping the ends of the cut length of knot wire about the line wire or stay wire to form a finished knot around the line wire-stay wire intersection.

37. The method as claimed in claim 36, further comprising supporting the line wire-stay wire intersection on the side opposite to the knot wire while bending the cut length of knot wire around the intersection.

38. The method as claimed in claim 36, further comprising supporting the knot wire against the line wire-stay wire intersection while bending and wrapping the ends of the cut length of knot wire around the line wire or stay wire.

39. The method as claimed in claim 36, comprising forming a number of line wire-stay wire intersections by providing a plurality of parallel line wires and providing a stay wire extending transversely across the plurality of line wires, and simultaneously at each line wire-stay wire intersection simultaneously forming a knot by:

providing a knot wire adjacent each line wire-stay wire intersection extending at an angle across the respective line wire-stay wire intersection;

cutting each length of knot wire and bending each cut length of knot wire around the respective line wire-stay wire intersection; and bending and wrapping the ends of each cut length of knot wire about the respective stay wire or the respective line wire to form a finished knot around each line wire-stay wire intersection.

* * * * *

UNITED STATES PATENT AND TRADEMARK OFFICE

CERTIFICATE OF CORRECTION

PATENT NO. : 6,668,869 B2
DATED : December 30, 2003
INVENTOR(S) : Kenneth Sidney Richardson It is certified that error appears in the above-identified patent and that said Letters Patent is hereby corrected as shown below:

Column 1,
Line 19, change “which it is” to -- which is --
Line 45, change “in case” to -- in the case --

Column 6,
Line 64, before “configuration” insert -- the --

Column 7,
Line 43, change “is has been” to -- it has been --

Column 10,
Line 60, after “invention” change “has” to -- have --

Column 11,
Line 42, after “claimed” insert -- in --

Column 12,
Line 25, change “knot box” to -- knot box, --

Signed and Sealed this

First Day of June, 2004

JON W. DUDAS
*Acting Director of the United States Patent and Trademark Office*